US005421065A

United States Patent [19]

Miotto

[11] Patent Number: 5,421,065

[45] Date of Patent: Jun. 6, 1995

[54] LEVER FASTENING DEVICE FOR FOOTWEAR

[75] Inventor: Onorio Miotto, Mosnigo Di Moriago, Italy

[73] Assignee: AM S.R.L, Mosnigo Di Moriago, Italy

[21] Appl. No.: 972,489

[22] PCT Filed: Aug. 29, 1991

[86] PCT No.: PCT/EP91/01639

§ 371 Date: Feb. 17, 1993

§ 102(e) Date: Feb. 17, 1993

[87] PCT Pub. No.: WO92/03945

PCT Pub. Date: Mar. 19, 1992

[30] Foreign Application Priority Data

Sep. 4, 1990 [IT] Italy ..... 61950 B/90
Oct. 25, 1990 [IT] Italy ..... 61968 B/90

[51] Int. Cl.[6] ..... A43C 11/14
[52] U.S. Cl. ..... 24/70 SK
[58] Field of Search ..... 24/71 R, 71 ST, 71 J, 24/71 SK, 68 J, 68 SK, 68 E, 69 SK, 70 SK, 70 J, 69 J

[56] References Cited

U.S. PATENT DOCUMENTS 3,345,705 10/1967 Gaupp ..... 24/71 J
4,651,392 3/1987 Olivieri .
4,796,336 1/1989 Scully ..... 24/71 ST
4,928,359 5/1990 Gagnebin ..... 24/71 J

FOREIGN PATENT DOCUMENTS 0093458 11/1983 European Pat. Off. .
15929 5/1906 Sweden ..... 24/71 SK

*Primary Examiner*—James R. Brittain
*Attorney, Agent, or Firm*—Hoffman, Wasson & Gitler

[57] ABSTRACT

A lever fastening device for footwear in general, including a lever hinged to a tensioning member fixed to one side of the vamp and a securing member fixed to the other side of the vamp and engageable by said lever, characterized in that the lever is hinged to the tensioning member and is provided with a transverse pin engageable in a corresponding hook portion of said securing member, a longitudinally movable slide being provided which is elastically retained in a position in which it locks said lever when this is in the fastened position.

14 Claims, 2 Drawing Sheets

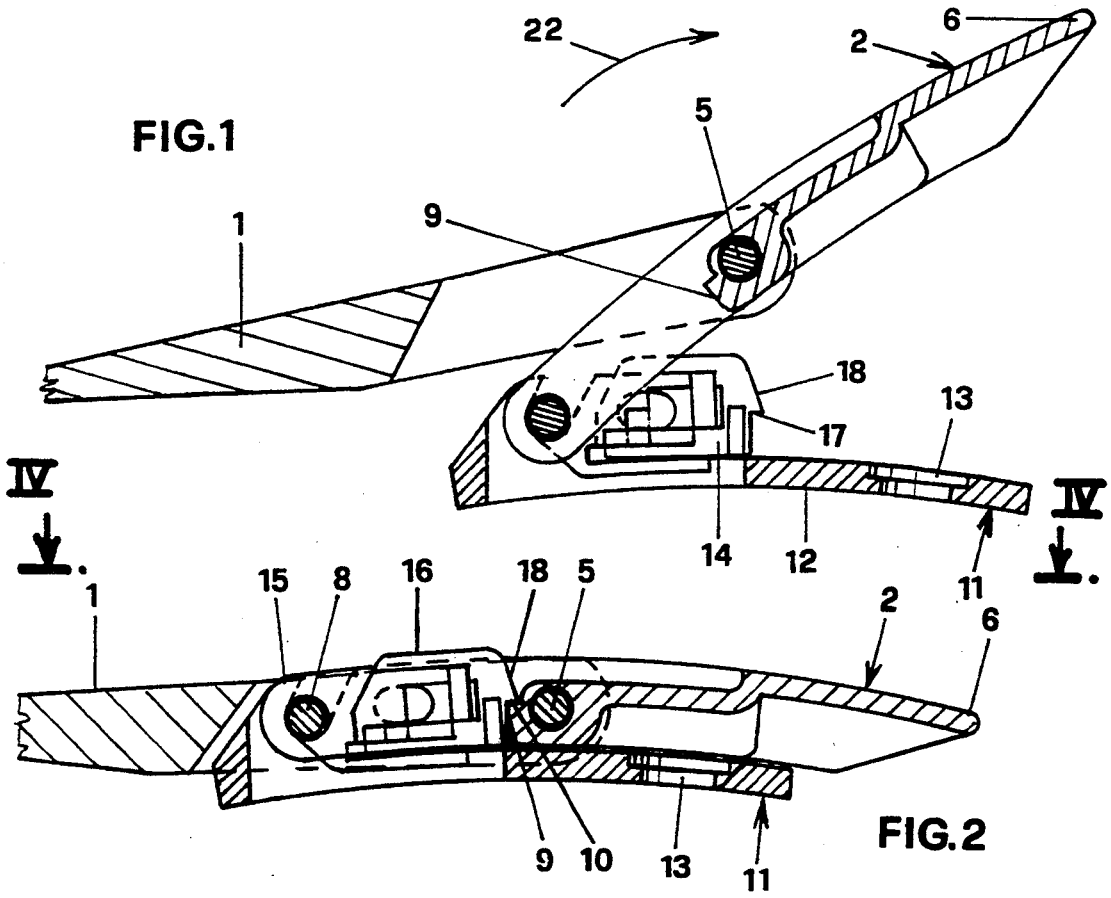
FIG.1
FIG.2
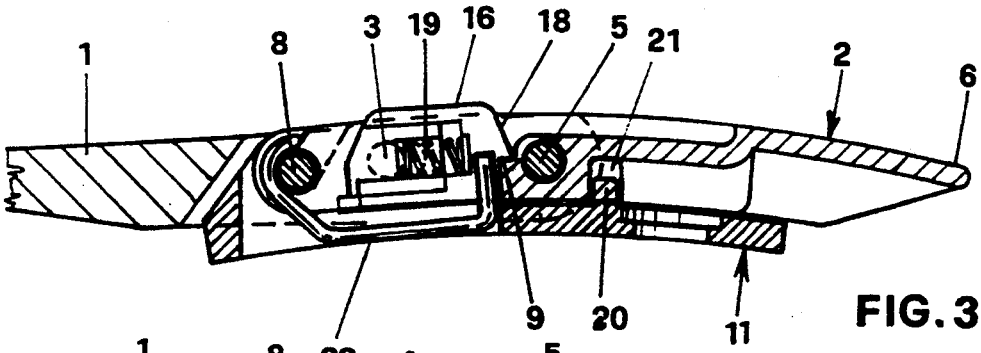
FIG.3
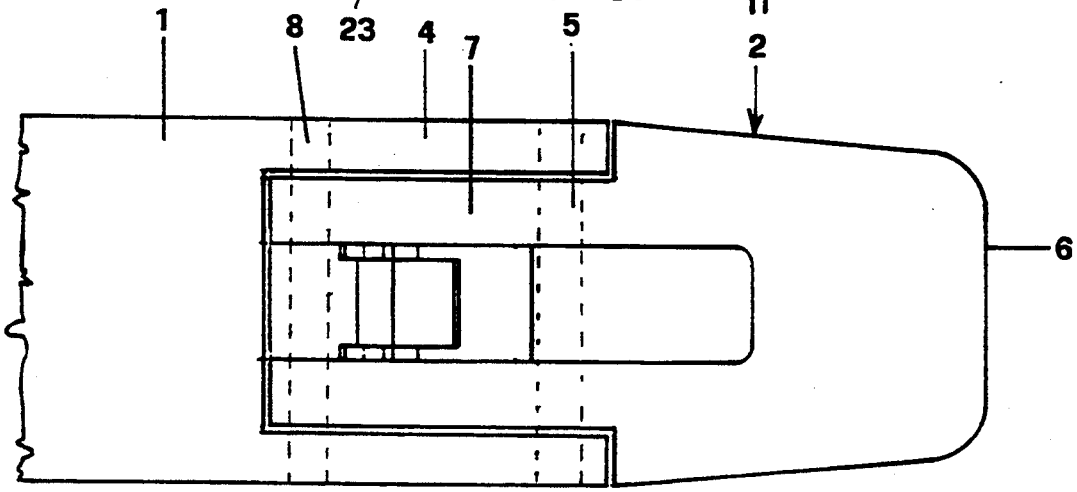
FIG.4

LEVER FASTENING DEVICE FOR FOOTWEAR

This invention relates to a lever fastening device for footwear.

Lever fastening devices for footwear are known. In particular, fastening devices are known comprising a strap or band fixed at one end to a side of the vamp of the footwear and securable at its other end to the other side. A lever tensions the strap, to hence fasten the footwear.

To prevent accidental opening of the footwear during use, the tensioning lever is associated with a locking member, which prevents its operation unless this latter has been intentionally released.

This locking member operates on the basis of being set considerably beyond a dead centre position at which maximum tension occurs. However, the fact of considerably exceeding this dead centre position means on the one hand that the tension is no longer a maximum, and on the other hand that a considerable force has to be applied to unfasten the footwear.

In addition the fact that the locking member has to be set considerably beyond the dead centre position means that it is very bulky in a direction perpendicular to the vamp, thus making the fastening device unsuitable for application to light footwear in general (jogging, trecking, gymnastics, motorcross, cross-country etc.).

Moreover, the known fastening devices with a lockable lever generally do not allow complete separation of the two parts secured to the two sides of the vamp, this often hindering complete opening of the footwear.

EP-A-0 093 458 describes a lever joined at a base plate fixed to one side of the vamp and a traction element, joined to this lever in correspondence of a transverse pin different from the articolating pin of the lever to the base plate. This traction element removably engages with the other side of the vamp. This is a traditional lever which is constructed in only one piece.

To overcome this latter drawback, fastening devices have been proposed in which the two elements cna be completely separated, but in this case no means are provided for locking the lever in the fastened state.

An object of the invention is to provide a fastening device for footwear in general, provided with a lever which can be locked in the fastened position.

A further object of the invention is to provide a fastening device of small overall size.

A further object of the invention is to provide a fastening device in which the two parts secured to the two sides of the vamp can be completeley separated from each other.

A further object of the invention is to provide a fastening device which can be unfastened by very comfortable and easy operation of the lever.

These and further objects which will be apparent from the description given hereinafter are attained according to the invention by a lever fastening device for footwear in general as described in claim 1.

The present invention is further clarified hereinafter with reference to the accompanying drawing in which:

FIG. 1 is a longitudinal section through a device according to the invention with the lever engaged with the securing member but not yet in the fastened conition;

FIG. 2 shows it in the same view as FIG. 1, but in the fastened condition;

FIG. 3 is a modified embodiment thereof, shown in the same view as FIG. 2;

FIG. 4 is a plan view thereof in the direction IV—IV of FIG. 2,

Figure 5:
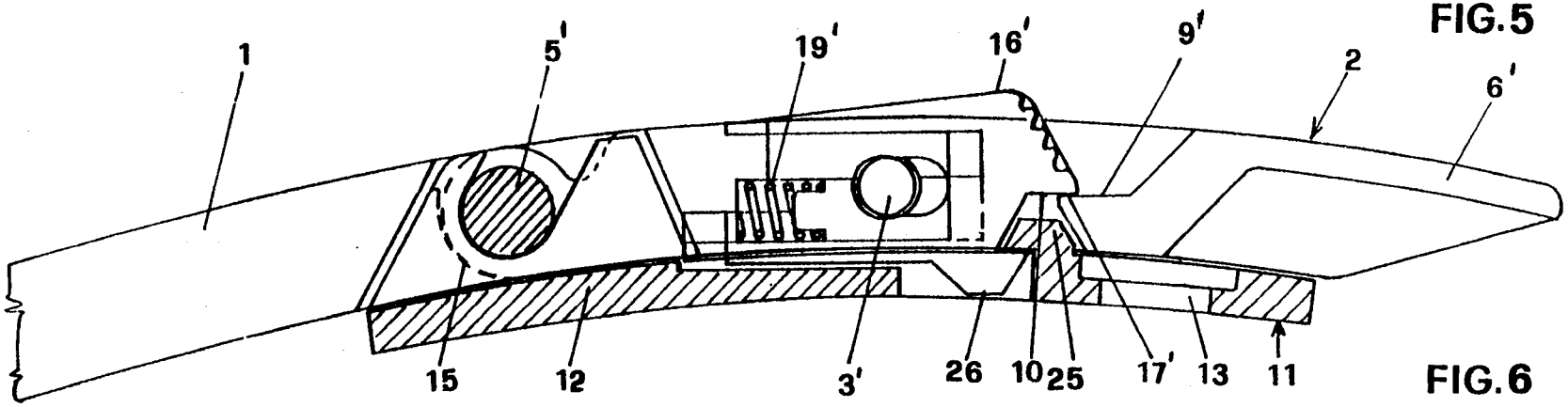
FIG. 5 is a same view as FIG. 1 of a second embodiment.

As can be seen from the FIGS. 1–4, the device according to the invention comprises substantially two separate parts, secured to the two sides of the footwear vamp. The first part consist of a strap 1 with one end free and the other end hinged to a tensioning lever 2. The free end can comprise transverse toothing, by which the strap adjustably engages a suitable retaining member fixed to one side of the vamp but not shown in the figures. At its other end the strap 1 is fork-shaped and is hinged through both its prongs 4 to the tensioning lever 2, on a transverse pin 5 situated in approximately a central position.

That part of the lever 2 extending from said pin 5 in the direction away from the strap 1 consists substantially of a hand grip 6, whereas the opposite part is fork-shapaed, with the prongs 7 lying between the prongs 4 of the strap 1 and connected by a transverse pin 8. At the end of this fork, i.e. at the base of the prongs 7, there is a stop tooth 9 with its active surface 10 substantially coplanar with the axis of the pin 5 and facing towards the outside of the lever 2.

The second part of the device according to the invention consists of a member 11 for securing the lever 2 to the other side of the vamp by being removably engageable with the lever. The member 11 comprises substantially a lower plate 12 provided with a hole 13 foe the passage of a rivet for its fixing to the underlying side of the vamp, and a block 14 emerging from said plate and provided at one end with a hook-shaped portion 15 for engaging the transverse pin 8 of the lever 2, in the manner described hereinafter.

From the lateral walls of the block 14 there outwardly project two short pins 3 for guiding a slide 16 movable longitudinally on said block 14 and provided with a tooth 17 cooperating with the tooth 9 of the lever 2. The tooth 17 has an active surface cooperating with the active surface 10 of the tooth 9, and an inclined lead-in surface 18 facing the outside of the lever.

A coil compression spring 19 is interposed between the block 14 and the slide 16 to elastically maintain the tooth 17 in its operating position.

In addition (see FIG. 3), the lower plate 12 is provided with a vertical peg 20 which when the lever is in the fastened configuration is housed in a corresponding recess 21 provided in the inner side of the lever 2.

The device according to the invention operates as follows: when the footwear is in its unfastened state the strap 1 is connected to one side of the vamp, its toothing having been positioned such as to allow the desired fastening effect. It is completely separated from the securing member 11 and allows the two sides of the vamp to be pulled completely apart.

To fasten the footwear the transverse pin 8 of the lever is firstly engaged in the hook portion 15 of the securing member 11, this being possible when the footwear is unfastened because of the hinge between the lever 2 and the strap 1. The lever 2 is then rotated in the direction of the arrow 22 in FIG. 1 to tension the strap 1 and hence fasten the footwear, this rotation terminating when the tooth 9 provided in it has engaged the tooth 17 of the slide 16. This engagement is possible because of the presence on the tooth 17 of the inclined surface 18, along which the tooth 9 slides, to longitudinally move the slide 16 against the elastic yielding of the spring 19.

After engagement between the teeth 9 and 17 has taken place it is no longer possible for the footwear to unfasten spontaneously, as any rotation of the lever 2 in the opposite direction is prevented.

In addition the engagement of the peg 20 in the recess 21 prevents relative longitudinal sliding between the lever and plate.

To unfasten the footwear it is necessary only to slide the slide 16 along the block 14 as far as is required to cause the tooth 17 to disengage the tooth 9, to allow the lever 2 to be rotated, and which after rotation can be completely separated from the securing member 11 by the disengagement of its pin 8 from the hook portion 15.

If total separation of the lever 2 from the securing member 11 is undesirable, a round steel bar 23 can be used, having one end embedded in the slide 16 and the other end curved to embrace the pin 8 and to partly occupy the aperture through which this latter enters its seat in the hook portion 15. In this case, both to engage the pin 8 of the lever 2 in its seat in the hook portion 15 and to disengage it from it, the slide 16 has to be previously operated in the same manner as for disengaging the locked lever, in order to cause the curved end of the round bar 23 to withdraw and allow entry (exit) of the pin 8 into (from) its seat. It is apparent that on releasing the slide 16, its elastic return into its rest position will cause the end of the bar 23 to again embrace the pin 8, and prevent total separation of the lever 2 from the securing member 11, even with the footwear unfastened.

From the aforegoing it is apparent that the fastening device of the invention is considerably more advantageous than similar devices, as it is of very small overall size and is therefore applicable to light footwear, and in addition allows the lever to be locked in the footwear fastening position, in contrast to current devices intended for this use.

Figure 6:
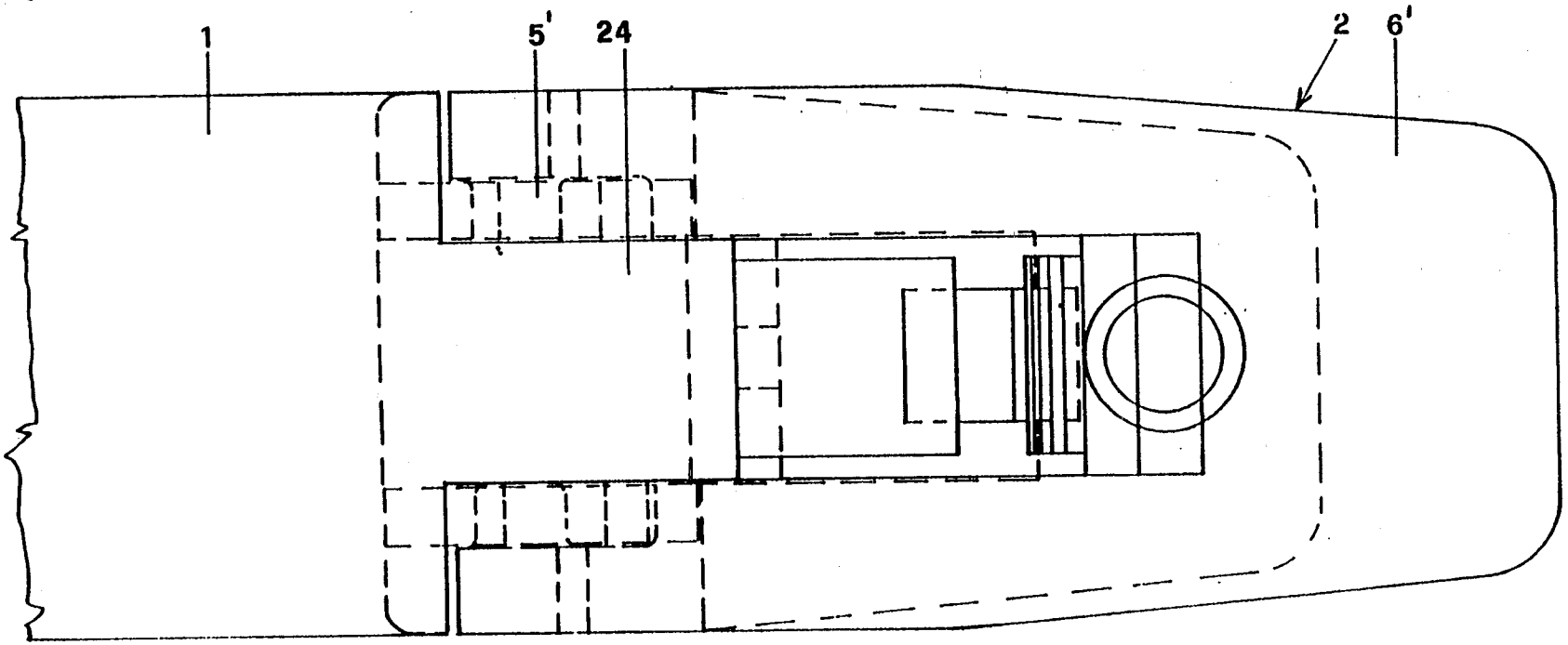
FIG. 6 is a plan view thereof.

In the embodiment shown in FIGS. 5 and 6 the strap 1 is provided with an appendix 24 interposed between the prongs of the lever 2 and is joined thereto on a transverse pin 5'.

The part of the lever 2 extending from said pin 5' in the direction away from the strap 1 consists substantially of a handgrip 6' which is provided with a stop tooth 9' with its active surface substantially coplanar with the axis of the pin 5' and facing towards the outside of the lever 2.

The front end of the appendix 24 is provided with two short pins 3', outwardly projecting, for guiding a slide 16' movable longitudinally and provided with a tooth 17' cooperating with the tooth 9' of the lever 2.

A coil compression spring 19' is interposed between the appendix 24 and the slide 16' to elastically maintain the tooth 17' in its operating position.

The lower plate 12 is provided with a tooth 25 for the engagement (in closure configuration of the lever 2) of a corresponding tooth 26 provided in the slide 16'.

The operating of the device is the following: to fasten the footwear, the transverse pin 5' is firstly engaged in the look portion. Then the lever 2 is rotated to tension the strap 1 and hence to fasten the footwear, this rotation terminating when the tooth 26 has engaged the tooth 25 of the member 11, and the tooth 9' of the lever 2 has engaged the tooth 17' of the slide 16'.

Furthermore the engagement of the tooth 26 with the tooth 25 prevents the lever and the strap from their raising.

What is claimed is:

1. A lever fastening device comprising: a forked shaped lever having prongs provided with a tensioning member hinged to said lever, which is affixed to a first side of a vamp and a securing member engageable by said lever, and affixed to a second side of said vamp, and said lever is provided with a transverse pin removably engageable in a corresponding hook portion of said securing member; and a longitudinally movable slide mounted on said securing member for sliding movement back and forth parallel to said prongs and which is elastically retained in a position in which said slide locks said lever when in a fastened position, wherein said longitudinally movable slide is housed within said prongs of said lever when said lever is in said fastened position.

2. A lever fastening device as claimed in claim 1 wherein said lever is hinged at an intermediate point to said tensioning member.

3. A lever device as claimed in claim 1 wherein said tensioning member is fork shaped and said lever is fork shaped, wherein prongs of said lever are internal to prongs of said tensioning member and connected together by a transverse pin.

4. A lever device as claimed in claim 3 wherein said lever further comprises a tooth at a base of said lever for cooperation with a tooth provided on said slide.

5. A lever device as claimed in claim 4, wherein said tooth of said slide comprises an enclosed surface whereby said tooth of said lever slides during fastening.

6. A lever device as claimed in claim 1, wherein said securing member further comprises a block for engaging and guiding said slide.

7. A lever device as claimed in claim 6 wherein said slide is secured to said block by a pair of mutually engaging pins and slots.

8. A lever device as claimed in claim 6, further comprising a spring interposed between said block and said slide.

9. A lever device as claimed in claim 1, further comprising a retention member applied to said slide to retain said transverse pin in a seat within said hook portion of said securing member.

10. A lever device as claimed in claim 9, wherein said retention member is a shaped round bar.

11. A lever device as claimed in claim 1, further comprising means for preventing relative longitudinal movement between said lever and said securing member when said lever is in said fastened position.

12. A lever device as claimed in claim 11, wherein said means for preventing relative longitudinal movement is a vertical peg located on said securing member for engagement with a corresponding recess provided in said lever.

13. A lever fastening device comprising: a forked shaped lever having prongs provided with a tensioning member hinged to said lever, which is affixed to a first side of a vamp and a securing member engageable by said lever, and affixed to a second side of said vamp, and said lever is provided with a transverse pin removably engageable in a corresponding hook portion of said securing member; and a longitudinally movable slide mounted on said tensioning member for sliding movement back and forth parallel to said prongs and which is elastically retained in a position in which said slide locks said lever when in a fastened position, wherein said longitudinally movable slide is housed within said prongs of said lever when said lever is in said fastened position.

14. A lever device as claimed in claim 13, wherein said end of said tensioning member is shaped to form guide elements for said slide.

* * * * *